US007147727B2

(12) United States Patent
Kim et al.

(10) Patent No.: US 7,147,727 B2
(45) Date of Patent: Dec. 12, 2006

(54) CU-BASED AMORPHOUS ALLOY COMPOSITION

(75) Inventors: Yu Chan Kim, Gyeonggi-do (KR); Eric Fleury, Gyeonggi-do (KR); Ki Bae Kim, Seoul (KR); Hyun Kwang Seok, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 10/877,558

(22) Filed: Jun. 25, 2004

(65) Prior Publication Data

US 2005/0211340 A1 Sep. 29, 2005

(30) Foreign Application Priority Data

Mar. 29, 2004 (KR) ..... 10-2004-0021120

(51) Int. Cl.
*C22C 45/00* (2006.01)
*H01F 1/04* (2006.01)

(52) U.S. Cl. ..... 148/403; 148/304; 148/561

(58) Field of Classification Search ..... 148/304, 148/403, 561
See application file for complete search history.

(56) References Cited

U.S. PATENT DOCUMENTS 6,521,058 B1 * 2/2003 Inoue et al. ..... 148/403

FOREIGN PATENT DOCUMENTS

| | | | |
|---|---|---|---|
| JP | 11009741 | * | 1/1999 |
| JP | 2002-256401 | | 9/2002 |
| WO | 02/070761 | * | 9/2002 |

* cited by examiner

*Primary Examiner*—Sikyin Ip
(74) *Attorney, Agent, or Firm*—Merchant & Gould P.C.

(57) ABSTRACT

The present invention relates to a Cu-based amorphous alloy composition having a chemical composition represented by the following general formula, by atomic %: $Cu_{100-a-b-c-d}Zr_aAl_b(M_1)_c(M_2)_d$, where a, b, c and d satisfy the formulas of $36 \leqq a \leqq 49$, $1 \leqq b \leqq 10$, $0 \leqq c \leqq 10$, and $0 \leqq d \leqq 5$, respectively, and c and d are not zero at the same time, and $M_1$, the 4th element added to a ternary alloy of Cu—Zr—Al, is one metal element selected from the group consisting of Nb, Ti, Be and Ag, and $M_2$, the 5th element added to the ternary alloy of the Cu—Zr—Al, is one amphoteric element or non-metal element selected from the group consisting of Sn and Si.

1 Claim, 6 Drawing Sheets

CU-BASED AMORPHOUS ALLOY COMPOSITION

BACKGROUND OF THE INVENTION

1. Field of the Invention

The present invention relates to a Cu-based amorphous alloy composition having the possibility of the use for the structural material, which enhances the formability and the efficiency for bulk amorphism of Cu-based alloy.

2. Description of the Related Art

Most metal alloys, when they congeal from the liquid phase, form crystal phase where the atoms are arrayed regularly. However, if the quenching speed is faster than a critical value, the nucleation and the growth of the crystal phase can be limited and the irregular atomic structure of the liquid phase can be maintained in the solid phase. This kind of alloy is called as "amorphous alloy". Amorphous alloy has tensile strength 2~3 times larger than that of the crystalline alloy and, also, is superior in corrosion resistance because of its homogeneous structure without grain boundary.

Since the amorphous structure was reported on the Au—Si based alloy in 1960, many kinds of amorphous alloys have been invented and used. However, in case of most amorphous alloys, as the nucleation and the growth of the crystal phase proceed rapidly in the super-cooled liquid phase, very fast quenching speed is required for the prevention of the formation of the crystal phase during the cooling process from the liquid phase. Therefore, most amorphous alloys have been produced through "rapid quenching technique" with the quenching speed of $10^4$~$10^6$ K/s in the forms of ribbon with thickness less than 80 μm, fine line with diameter less than 150 μm or fine powder with diameter less than hundreds of μm. Further, the amorphous alloys, which are produced with the rapid quenching technique, have restriction in their shape and size, and so, we have difficulties in their commercialization. Therefore, it is required to develop the alloy with low critical quenching speed, which can avoid the formation of crystal phase during the cooling process from the liquid phase.

If the formability of amorphous alloy is excellent, the production of bulk amorphous alloy may be possible by means of a casting method. For example, for the manufacturing of amorphous alloy with about 1 mm thickness, crystallization should not occur even at the low quenching speed of $10^3$ K/s. Besides the low quenching speed, "super-cooled liquid region" is an important factor for the production of bulk amorphous alloy in the industrial perspective. In the super-cooled liquid region, the viscous flow enables the formation of amorphous alloy, which makes it possible to manufacture articles with a certain shape from the amorphous alloy.

The amorphous alloys, which are Fe-based, Ti-based, Co-based, Zr-based, Ni-based, Pd-based, Cu-based and the like, have been developed till the present. Among the Cu-based alloys are the binary alloys of Cu-M (M=Ti, Zr or Hf), ternary alloys of Cu—Mg-Ln (Ln=La, Sm, Eu, Tb, Er or Lu), Cu—Zr—Ti, Cu—Hf—Ti and Cu—Zr—Al, and quaternary alloys of Cu—Zr—Hf—Ti, Cu—Zr—Ti—Y and Cu—Ti—Zr—Ni.

However, in the prior art, amorphous alloys were produced in the forms of ribbon or powder with thickness of dozens of μm with the "rapid quenching technique". The recently developed Cu-based bulk amorphous alloys having maximum diameter of about 5 mm also have restrictions in the practical use.

SUMMARY OF THE INVENTION

The present invention has been made to solve the above-mentioned problems.

The object of the present invention is to increase the efficiency of amorphism through enhancing the formability in Cu-based amorphous alloy and to provide Cu-based amorphous alloy that can be used as structural material.

To accomplish the above object, the Cu-based amorphous alloy composition according to the present invention is characterized to have a chemical composition represented by the following general formula, by atomic %: $Cu_{100-a-b-c-d}Zr_aAl_b(M_1)_c(M_2)_d$, where a, b, c and d satisfy the formulas of $36 \leqq a \leqq 49$, $1 \leqq b \leqq 10$, $0 \leqq c \leqq 10$, and $0 \leqq d \leqq 5$, respectively, and c and d are not zero at the same time.

In the Cu-based amorphous alloy composition according to the present invention, $M_1$ is metal element and $M_2$ is either amphoteric element or non-metal element.

In the Cu-based amorphous alloy composition according to the present invention, $M_1$ is element selected from the group consisting of Nb, Ti, Be and Ag; and $M_2$ is element selected from the group consisting of Sn and Si.

DETAILED DESCRIPTION OF THE INVENTION

Figure 1A:
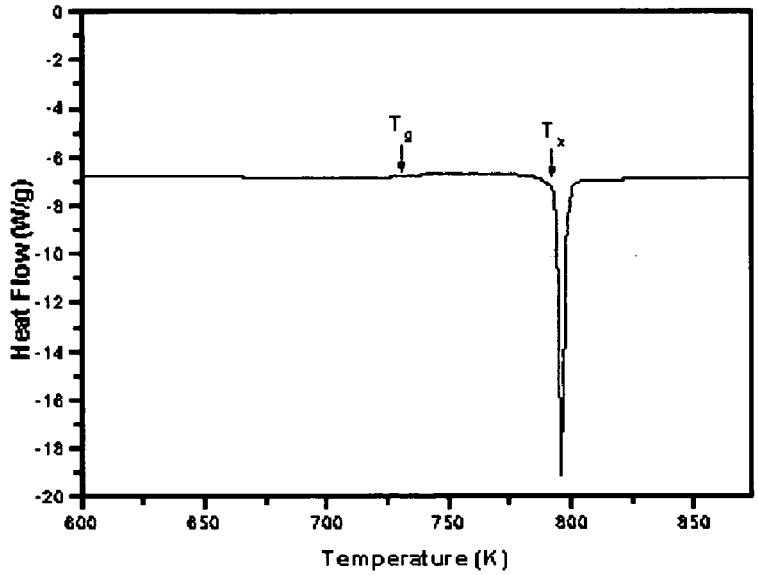
FIG. 1*a* shows the analyzed results of the manufactured Cu-based amorphous alloy composition of $Cu_{50}Zr_{43}Al_7$ through DSC (differential scanning calorimetry).
Figure 1B:
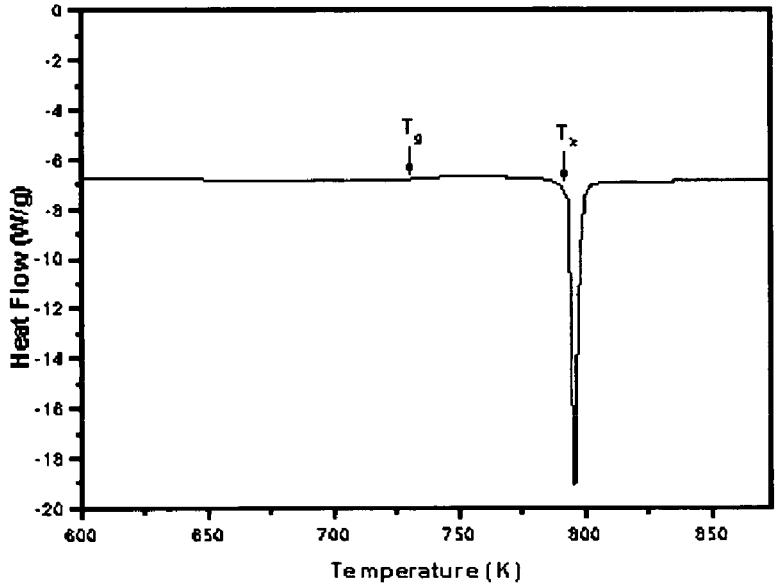
FIG. 1*b* shows the analyzed results of the manufactured Cu-based amorphous alloy composition of $Cu_{43}Zr_{43}Al_7Ag_7$ through DSC.
Figure 1C:
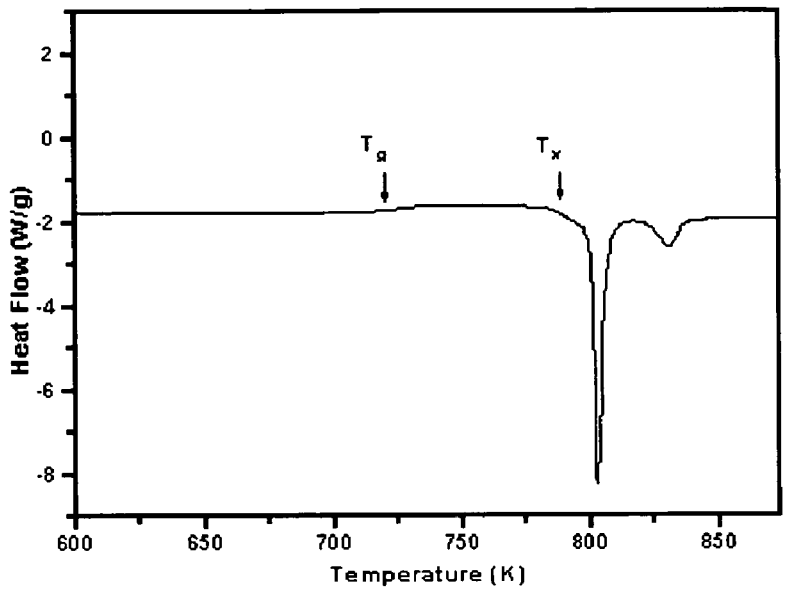
FIG. 1*c* shows the analyzed results of the manufactured Cu-based amorphous alloy composition of $Cu_{43}Zr_{43}Al_7Be_7$ through DSC.
Figure 1D:
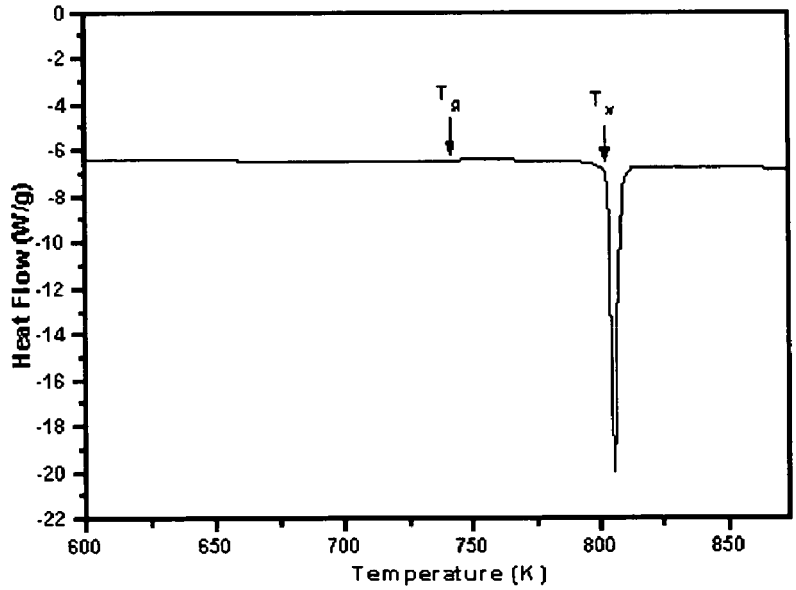
FIG. 1*d* shows the analyzed results of the manufactured Cu-based amorphous alloy composition of $Cu_{49}Zr_{43}Al_7Sn_1$ through DSC.

In the present invention, the ternary alloy of Cu—Zr—Al is added with metal element, amphoteric element or non-metal element as the $4^{th}$ or $5^{th}$ element to obtain excellent amorphous formability. According to the present invention, the strength of Cu alloy is increased through the bulk amorphism of Cu alloy and, therefore, the Cu alloy can be used for the structural material.

The general theories obtained from the experience will be briefly explained in the following before the explanation of the Cu-based amorphous alloy composition according to the present invention.

The amorphous formability of amorphous alloy can be increased through the mixing with elements that have negative heat of mixing, and the amorphous alloy has atomic diameter differences of more than 10% compared to the multi-component system that has more than three elements. Further, by experience, it is known that the lower the melting temperature of the mixed alloy, the easier the formation of amorphous structure. Superior amorphous formability can be obtained by restricting the nucleation and the growth of the crystal phase through lowering the diffusivity of the atoms and the free energy of the system, which result from close-packed atomic structure and strong atomic binding between the hetero elements.

In the present invention, Cu—Zr—Al ternary Cu-based alloy is selected as the basic composition based on the above-mentioned empirical theories.

In the composition of $Cu_{100-a-b-c-d}Zr_aAl_b(M_1)_c(M_2)_d$, the area of the composition is selected where the amorphous structure can be obtained. In the above chemical formula, if a<36 atomic % or b>10 atomic %, the close-packed effect, which is found in the multi-component system, can't be obtained so that the formation of excellent amorphous alloy becomes difficult.

If a>49 atomic %, the Cu-based alloy falls outside of the amorphous area.

The present invention satisfies the multi-component system condition by adding the $4^{th}(M_1)$ or the $5^{th}(M_2)$ elements to said Cu—Zr—Al alloy. The $4^{th}(M_1)$ is metal element and can be the element selected from the group consisting of Nb, Ti, Be and Ag; and $5^{th}(M_2)$ is amphoteric element or non-metal element and can be the element selected from the group consisting of Sn and Si. Herein, non-metallic element Si is selected based on the experience that, in general, the metal-nonmetal pairs are easy for the formation of amorphous structure than the metal-metal pairs.

In the $4^{th}(M_1)$ or the $5^{th}(M_2)$ elements, Ti and Si showed negative heat of mixing of −9 KJ/g-at and −2 KJ/g-at, respectively, when they are mixed with Cu. And, Be, Ag, Sn and Si showed negative heat of mixing of −43 KJ/g-at, −20 KJ/g-at, −43 KJ/g-at and −67 KJ/g-at, respectively, when they are mixed with Zr. Nb, Ti and Ag have favorable condition as they show excellent negative heat of mixing of −18 KJ/g-at, −30 KJ/g-at and −4 KJ/g-at, respectively, when they are mixed with Al (refer to Table 1).

TABLE 1

| Reactive element | | heat of mixing (KJ/g-at) |
|---|---|---|
| Cu | Ti | −9 |
| | Si | −2 |

TABLE 1-continued

| Reactive element | | heat of mixing (KJ/g-at) |
|---|---|---|
| Zr | Be | −43 |
| | Ag | −20 |
| | Sn | −43 |
| | Si | −67 |
| Al | Nb | −18 |
| | Ti | −30 |
| | Ag | −4 |

In the above chemical formula, the reason for setting the numerical range $0 \leqq c \leqq 10$, and $0 \leqq d \leqq 5$ in $(M_1)_c(M_2)_d$ is as follows; That is, if c>10 atomic % and d>5 atomic %, the close-packed effect, which is found in the multi-component system, can't be obtained so that the formation of amorphous alloy becomes difficult. And, if c and d are 0 atomic % at the same time, the composition may come to be identical with the Cu-based amorphous alloy of the prior art. Accordingly, the case when c and d are O atomic % simultaneously is excluded in the composition according to the present invention.

EXAMPLE

Examples of Cu-based amorphous alloy according to the present invention are set forth in the following. However, these are given by way of illustration and not of limitation.

In the first place, metal element (Nb, Ti, Be or Ag), amphoteric element or non-metal element (Sn or Si) are mixed in atomic % to the ternary Cu-based alloy of Cu—Zr—Al as shown in the following Table 2. Then, the Cu-based amorphous alloy composition is produced in the shape of rod through suction casting method. In concrete, the composition is arc-melted and maintained in the arc-melting mold with surface tension. The arc-melted composition is sucked into the Copper mold. Then, rod-shaped samples with the length of 50 mm and varying diameter of 1~9 mm are produced.

The Cu-based alloy produced according to the above-mentioned method is measured for $T_g$ (glass transition temperature) and $T_x$ (crystallization temperature) with DSC (differential scanning calorimetry). Also, $T_m$ (melting temperature) is measured with DTA (differential thermal analysis). From the above-measured results, the values of $\Delta T_x$ (supercooled liquid region)$=T_x-T_g$, $T_{rg}$ (reduced glass transition temperature) and $\gamma=T_x/(T_g+T_m)$ are calculated. These are the representative values that are used for the estimation of the amorphous formability.

The maximum diameter of the bulk amorphous alloy $d_{max}$, a factor proportional to the amorphous formability, denotes the maximum bulk amorphous forming diameter, when halo pattern characteristic to the amorphous alloy is found in the X-ray diffraction test of the rod-shaped sample cut into appropriate size. The results are shown in Table 2.

TABLE 2

| | Composition (atomic %) | $T_g$ | $T_x$ | $\Delta T_x$ | $T_{rg}$ | $\gamma$ | $d_{max}$(mm) |
|---|---|---|---|---|---|---|---|
| Example of the present invention | $Cu_{45}Zr_{43}Al_7Ag_5$ | 727 | 794 | 67 | 0.638 | 0.426 | ≧6 |
| | $Cu_{43}Zr_{43}Al_7Ag_7$ | 722 | 794 | 72 | 0.642 | 0.430 | ≧8 |
| | $Cu_{43}Zr_{43}Al_7Be_7$ | 723 | 800 | 77 | 0.642 | 0.432 | ≧8 |
| | $Cu_{49}Zr_{43}Al_7Si_1$ | 748 | 809 | 61 | 0.609 | 0.409 | ≧5 |
| | $Cu_{49}Zr_{43}Al_7Sn_1$ | 746 | 807 | 61 | 0.593 | 0.420 | ≧5 |
| | $Cu_{47}Zr_{43}Al_7Si_3$ | 754 | 808 | 54 | 0.572 | 0.403 | ≧4 |

TABLE 2-continued

| | Composition (atomic %) | $T_g$ | $T_x$ | $\Delta T_x$ | $T_{rg}$ | $\gamma$ | $d_{max}$(mm) |
|---|---|---|---|---|---|---|---|
| | $Cu_{43}Zr_{42}Al_7Ag_7Si_1$ | 742 | 813 | 71 | | | ≧6 |
| | $Cu_{43}Zr_{42}Al_7Ag_7Sn_1$ | 730 | 799 | 69 | | | ≧6 |
| Comparative | $Cu_{50}Zr_{45}Al_5$ | 723 | 797 | 74 | 0.62 | 0.422 | <1 |
| Example | $Cu_{60}Zr_{30}Ti_{10}$ | 713 | 750 | 37 | 0.62 | 0.403 | <1 |
| | $Cu_{60}Hf_{30}Ti_{10}$ | 725 | 785 | 60 | 0.62 | 0.414 | <2 |

In general, if $d_{max}$>1 mm, the bulk amorphous formability is rated as excellent. According to the results represented in Table 2, the minimum $d_{max}$ value of $Cu_{50}Zr_{43}Al_7$ is 4 mm, and the maximum $d_{max}$ value of $Cu_{43}Zr_{43}Al_7Ag_7$ is 8 mm, which show that the Cu-based amorphous alloy composition according to the present invention has excellent amorphous formability.

The super-cooled liquid region $\Delta T_x$, which is measured with DTA, is above 50K in all of the composition range, and other factors representing the amorphous formability such as $T_{rg}$ and $\gamma$ show the values of more than 0.60 and more than 0.40 respectively, which are characteristic to the alloy with excellent amorphous formability.

Figure 2A:
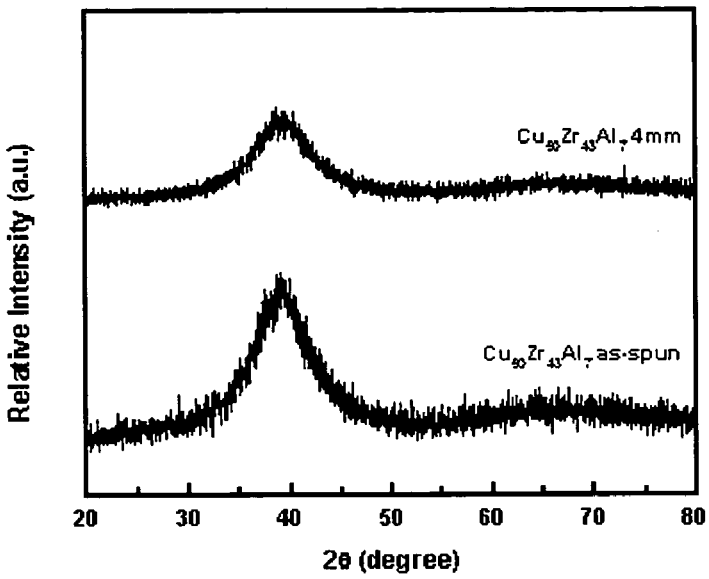
FIG. 2*a* shows the analyzed results of the X-ray diffraction pattern of the ribbon and the 4 mm rod-shaped test bar made of $Cu_{50}Zr_{43}Al_7$ alloy.
Figure 2B:
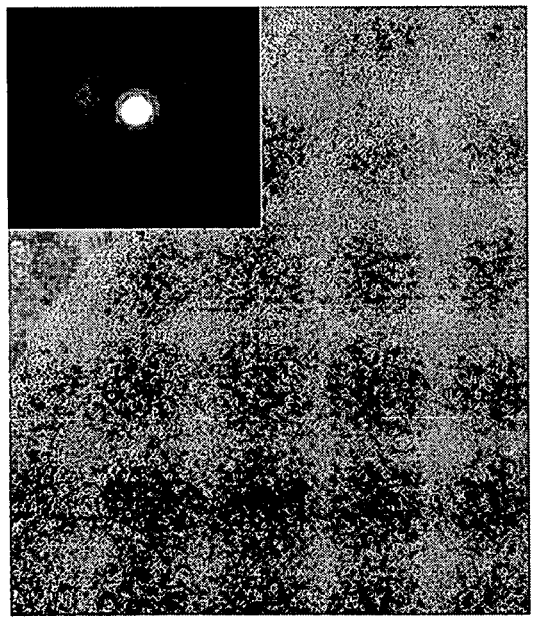
FIG. 2*b* is the picture showing the bright field image and selected area diffraction of the 4 mm rod-shaped test bar made of $Cu_{50}Zr_{43}Al_7$ alloy through TEM (Transmission Electron Microscopy).
Figure 3A:
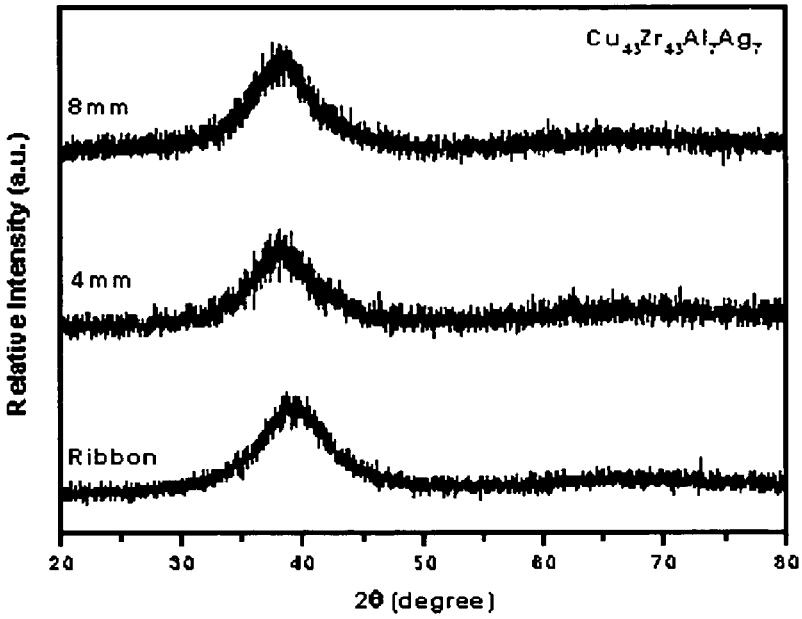
FIG. 3*a* shows the analyzed results of the X-ray diffraction pattern of the ribbon, the 4 mm rod-shaped test bar and the 8 mm cylinder-shaped test bar made of $Cu_{43}Zr_{43}Al_7Ag_7$ alloy.
Figure 3B:
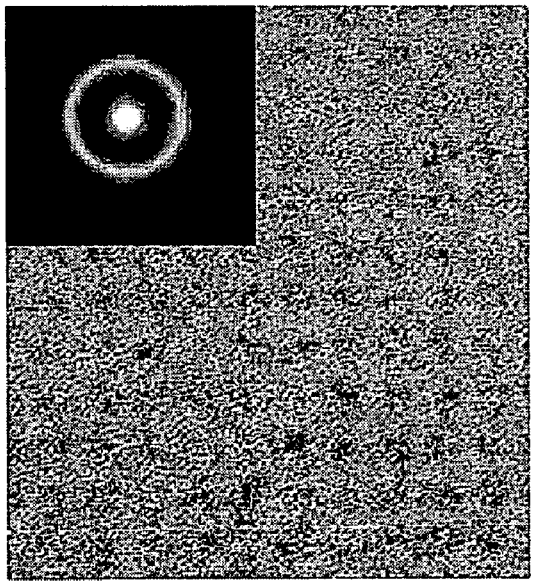
FIG. 3*b* is the picture showing the bright field image and selected area diffraction of the 8 mm rod-shaped test bar made of $Cu_{43}Zr_{43}Al_7Ag_7$ alloy through TEM.

The maximum diameter of the bulk amorphous alloys $d_{max}$, wherein the alloys are the tenary alloy of $Cu_{50}Zr_{43}Al_7$ and the quaternary alloy of $Cu_{43}Zr_{43}Al_7Ag_7$, can be confirmed in the result of X-ray diffraction test shown in FIG. 2*a* and FIG. 3*a*. In the results of above test, the quaternary alloy of $Cu_{43}Zr_{43}Al_7Ag_7$ showed $d_{max}$ value of more than 8 mm, which means the efficient bulk amorphous formability, while the ternary alloy of $Cu_{50}Zr_{43}Al_7$ showed $d_{max}$ value of less than 4 mm. As shown in FIG. 2*b* and FIG. 3*b*, the result of TEM (Transmission Electron Microscope) analysis shows the identical result with that of the X-ray diffraction test shown in FIG. 2*a* and FIG. 3*a*.

Figure 4:
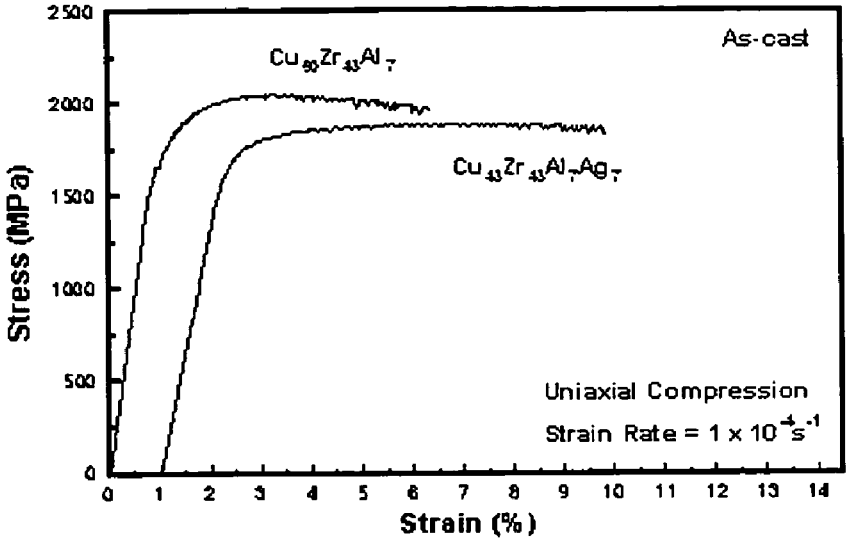
FIG. 4 is a diagram showing the stress-strain curve graph of the amorphous alloy composition of $Cu_{50}Zr_{43}Al_7$ and $Cu_{43}Zr_{43}Al_7Ag_7$.

From the above-mentioned results of analysis, the superior bulk amorphous formability of the Cu-based amorphous alloy composition has been confirmed. Further, as illustrated in FIG. 4, the Cu-based amorphous alloy according to the present invention showed excellent fracture strength of about 2 Gpa, which is superior to that of the Cu-based amorphous alloy of the prior art.

Figure 5A:
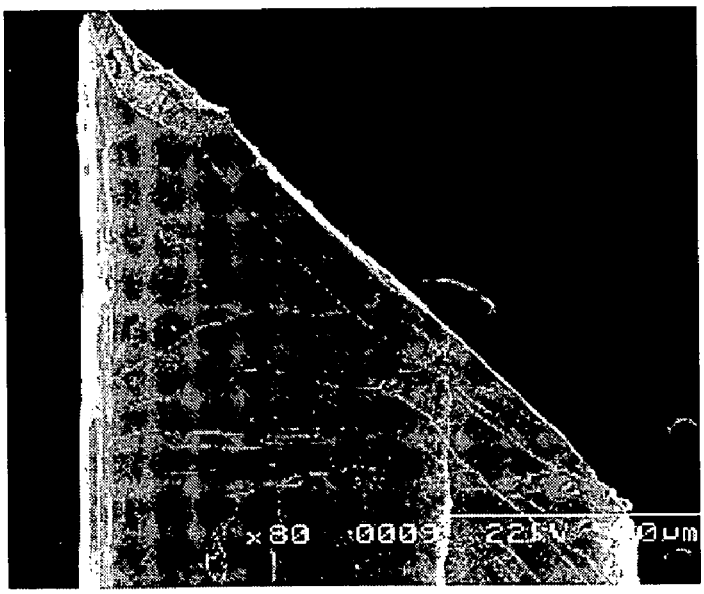
FIGS. 5*a*, 5*b* and 5*c* are the pictures showing the fracture surface and the shear distortion band of the $Cu_{43}Zr_{43}Al_7Ag_7$ alloy manufactured according to the present invention and fractured for the observation with the scanning electron microscope.
Figure 5B:
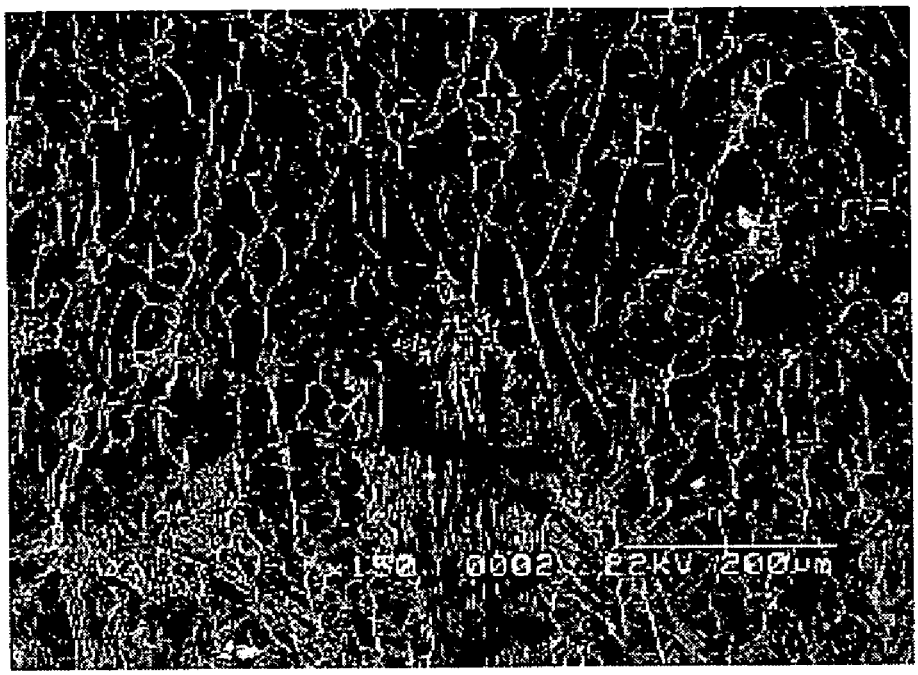
Figure 5C:
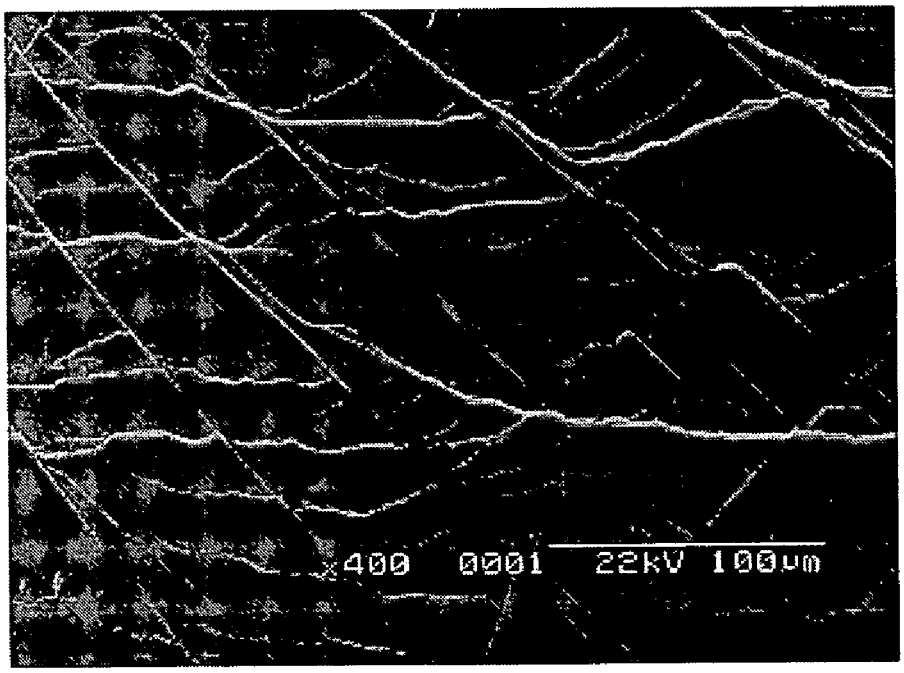

As shown in FIGS. 5*a*, 5*b* and 5*c*, when the fractured plane is examined with scanning electron microscope, the fracture was made to form 45° with the direction of weight, and the fractured surface showed shear distortion band with vein pattern, which confirm the excellent ductility of the Cu-based amorphous alloy according to the present invention.

In the present invention, the ternary alloy of Cu—Zr—Al is added with metal element, amphoteric element or non-metal element as the $4^{th}$ or $5^{th}$ element to obtain excellent amorphous formability. According to the present invention, increased the strength of Cu alloy through the bulk amorphism of Cu alloy, which enables the Cu alloy to be used for the structural material. Especially, the Cu-based amorphous alloy according to the present invention satisfies the general rule obtained from experiences, and the present invention also provides potentiality for the production of amorphous structure of other kinds of alloys.

What is claimed:

1. A Cu-based amorphous alloy composition consisting essentially of a chemical composition represented by the following general formula, by atomic %: $Cu_{100-a-b-c-d}Zr_aAl_b(M_1)_c(M_2)_d$, where a, b, c and d satisfy the formulas of 36≦a≦49, 1≦b≦10, 0≦c≦10, and 0≦d≦5, respectively, and c and d are not zero at the same time, and $M_1$, the 4th element added to a ternary alloy of Cu—Zr—Al, is one metal element selected from the group consisting of Nb, Ti, Be and Ag, and $M_2$, the 5th element added to the ternary alloy of the Cu—Zr—Al, is one amphoteric element or non-metal element selected from the group consisting of Sn and Si.

* * * * *